United States Patent [19]

Capen

[11] Patent Number: 4,571,882

[45] Date of Patent: Feb. 25, 1986

[54] STAND FOR TREES, STANDARDS AND THE LIKE

[76] Inventor: John M. Capen, 1321 Sanford Ave., Vermilion, Ohio 44089

[21] Appl. No.: 545,886

[22] Filed: Oct. 27, 1983

[51] Int. Cl.[4] ..... A47G 7/02

[52] U.S. Cl. ..... 47/40.5; 248/524

[58] Field of Search ..... 47/40.5; 248/524, 514, 248/516

[56] References Cited

U.S. PATENT DOCUMENTS

| | | | |
|---|---|---|---|
| 2,609,169 | 9/1952 | Kroeger | 47/40.5 |
| 2,893,668 | 7/1959 | Applegate | 47/40.5 |
| 3,719,340 | 3/1973 | Norton | 248/48 |
| 3,779,493 | 12/1973 | Gidlof | 248/44 |
| 4,156,323 | 5/1979 | Scheffler | 47/40.5 |
| 4,310,989 | 1/1982 | Shannon, Jr. | 47/40.5 |
| 4,320,886 | 3/1982 | Stodola | 248/523 |

*Primary Examiner*—Robert E. Bagwill
*Assistant Examiner*—Bradley M. Lewis
*Attorney, Agent, or Firm*—Gustalo Nunez

[57] ABSTRACT

A Christmas tree stand for supporting Christmas trees of any size and formation. The support stand is designed such that the tree, if deformed or if placed in the stand at an angle, can be aligned very easily and quickly in a perpendicular position with respect to any type of floor, whether it be irregular or uneven. The receptacle for retaining the Christmas tree is formed integral therewith a hemispherical ball which is received by two adjustable jaws which form a hemispheric cavity. The receptacle is further provided, with a plurality of machine screws for retaining the Christmas tree trunk in a fixed vertical position in the receptacle, notwithstanding the shape or deformity of the tree.

3 Claims, 9 Drawing Figures

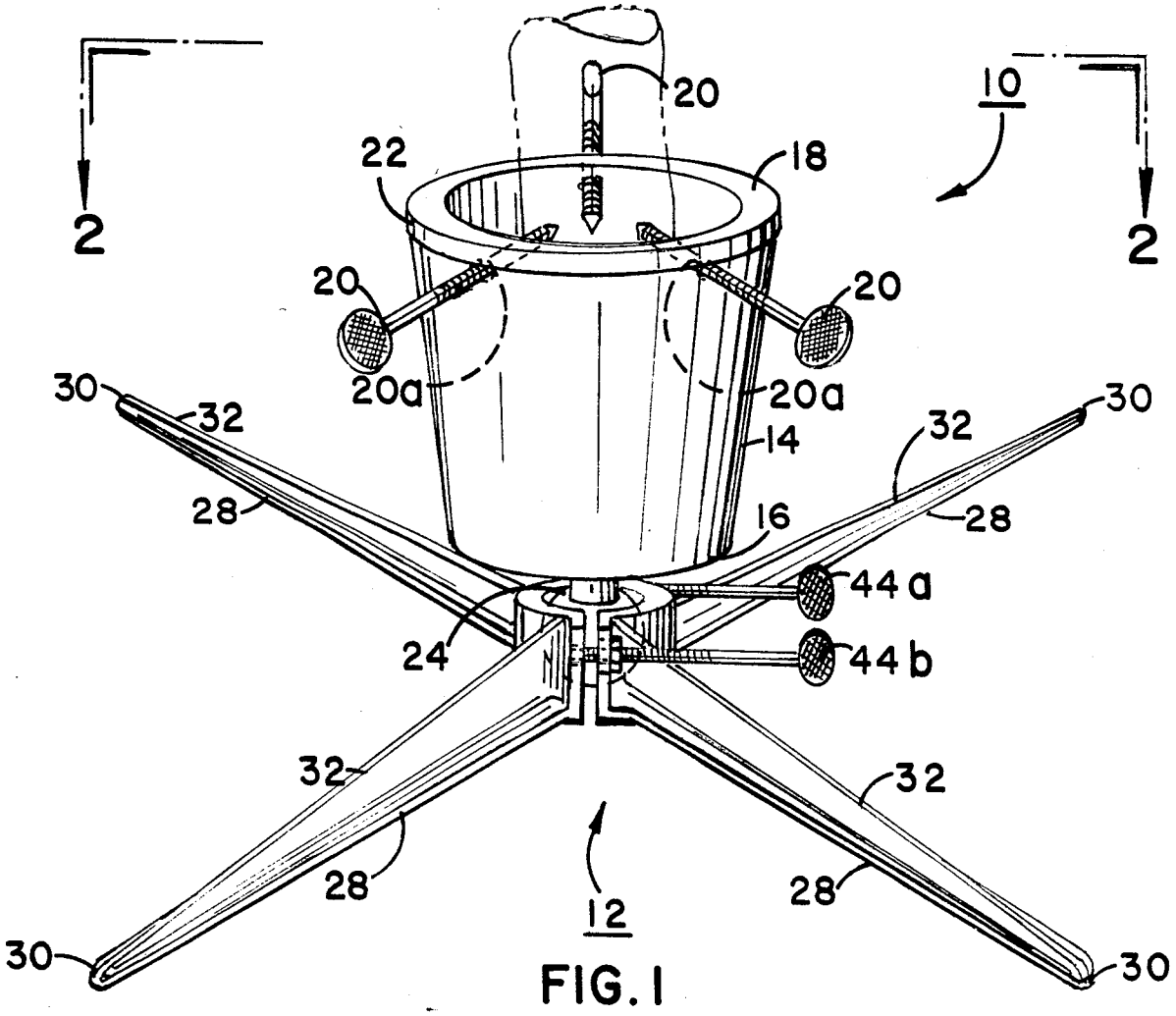
FIG. 1
FIG. 1a
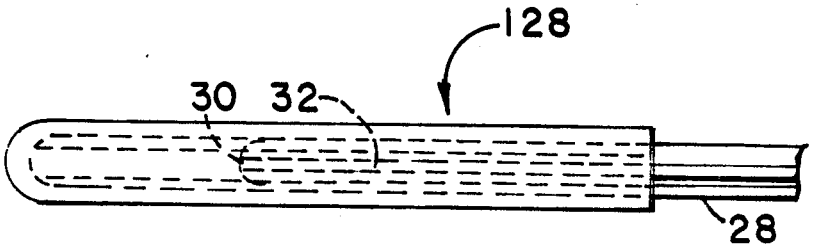
FIG. 1b
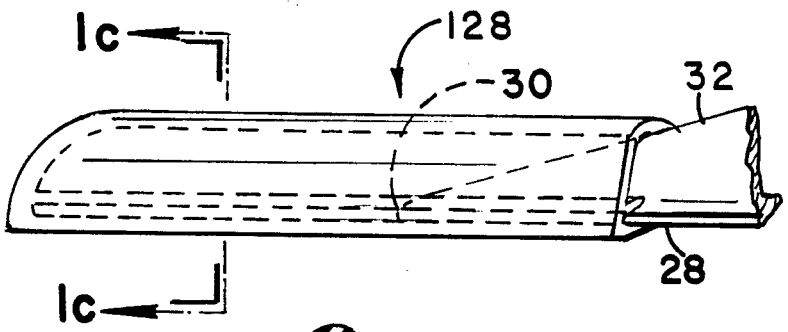
FIG. 1c
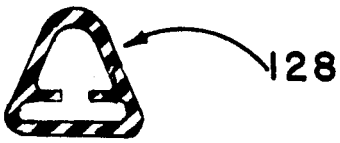

STAND FOR TREES, STANDARDS AND THE LIKE

BACKGROUND OF THE INVENTION

This invention relates in general to means for supporting christmas trees, standards, flag poles and the like in a perpendicular position. Specifically, the stand contemplated herein, is the ideal stand for supporting christmas trees of any weight, configuration and size.

DESCRIPTION OF THE PRIOR ART

Various styles and designs have been devised for securing and holding christmas trees. The early stands were rather mechanically complex and expensive to manufacture. Also, they were difficult to use because the inherent designs made the alignment of the tree a difficult process.

An early example of such a stand is Pat. No. 3,719,340 granted to Norton. This patent relates to a spider support for supporting a standard having a central hub which further includes a receptacle. The stand disclosed by Norton, has a plurality of spaced slots for receiving removably installable anchors of spoke elements which function as the supports for the stand. Presumably, these spokes maybe installed on the stand in a direction of 360° with apparently no limits other than space requirements. The stand as disclosed by Norton and as described in the figures, particularly FIG. 3, is a mechanically complex structure utilized to perform a simple function, that is, to hold a tree or standard in an upright position.

Another example of a christmas tree stand is U.S. Pat. No. 3,779,493 granted to Gidlof. Gidlof discloses a stand intended for christmas trees comprising a water container having means to secure the tree such that the lower part of the tree trunk is fixed in the container. He also discloses a support for the container, the support and the container being interconnected by means of a ball joint which includes a clamping device for the ball joint. The ball joint does permit Gidlof to adjust a christmas tree stand into an infinite number of positions. However, the inherent design disclosed in FIGS. 1 and 2, disclose a christmas tree stand that although much more simpler in construction than Norton, still is complex for the simple function that it was designed for. It would still be difficult to adjust the stand in the position that one wanted because of type of ball and clamp connection utilized by Gidlof.

U.S. Pat. No. 4,320,886 discloses a spacer to be used in conjunction with christmas tree stands. The spacer is in the form of a sleeve member having a plurality of threaded openings. The spacer, in theory, allegedly permits rapid alignment and securement of a christmas tree to a tree stand with a minimum of effort. However, in actual practice, such is not the case. A cursory review of the drawings reveals that this too, is mechanically complex and cumbersome to work with.

SUMMARY OF THE INVENTION

The stand contemplated herein is one which is very simple in construction, very simple in adjustment and very inexpensive to manufacture. The stand comprises a receptacle having integral thereto, a ball member. The receptacle is further provided with a plurality of retaining screws, in the instant case, three, although no necessarily restricted thereto. Also provided are two members which comprise the support portion of the stand and which when connected to each form a cross type assembly having at the intersection of the arms, an opening formed therein, said opening having a shape of a hemisphere equal in size to the ball formed on the receptacle. The ball is placed in the hemispheric opening and the size of the hemispherical opening is easily adjusted by two adjusting screws associated with the opening. A tree or standard is placed in the receptacle and held in place by the retaining screws. The tree is placed in any desired position simply by pushing it and tightening the adjusting screws associated with the hemispheric opening.

BRIEF DESCRIPTION OF THE DRAWINGS

Further objectives and advantages of the invention will be hereinafter referred to and/or be apparent from the following description of the preferred embodiment of the improved stand construction shown particularly in the accompanying drawings and are set forth in the appended claims.

FIG. 1 is a perspective view of the improved stand.

FIG. 1*a* is a top view of one form of a support leg extender.

FIG. 1*b* is a side view of the support leg extender.

FIG. 1*c* is a sectional view of the support leg extented taken along line 1*c*—1*c* of FIG. 1*b*.

DETAILED DESCRIPTION OF THE PREFERRED EMBODIMENT

Figure 2:
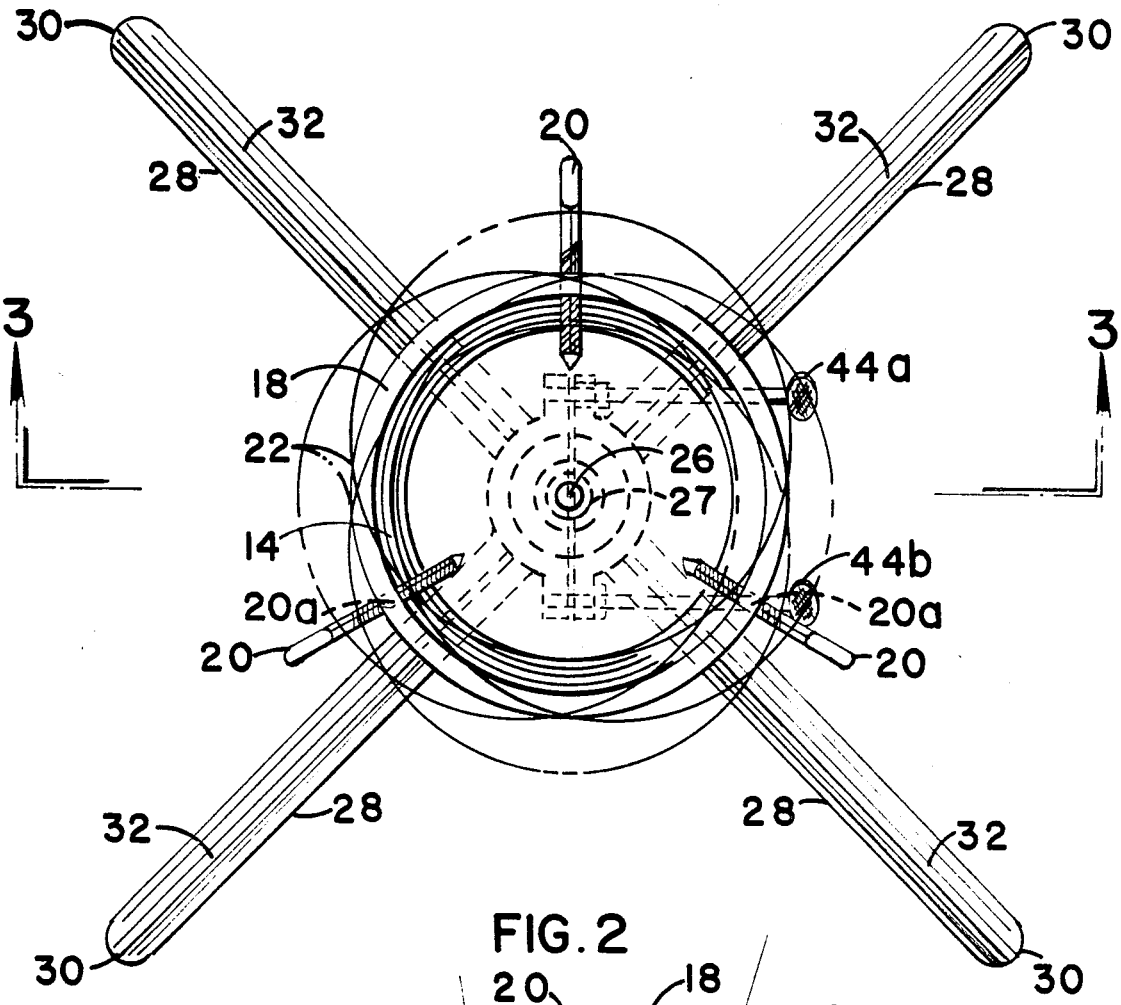
FIG. 2 is a top plan view of the improved stand.
Figure 3:
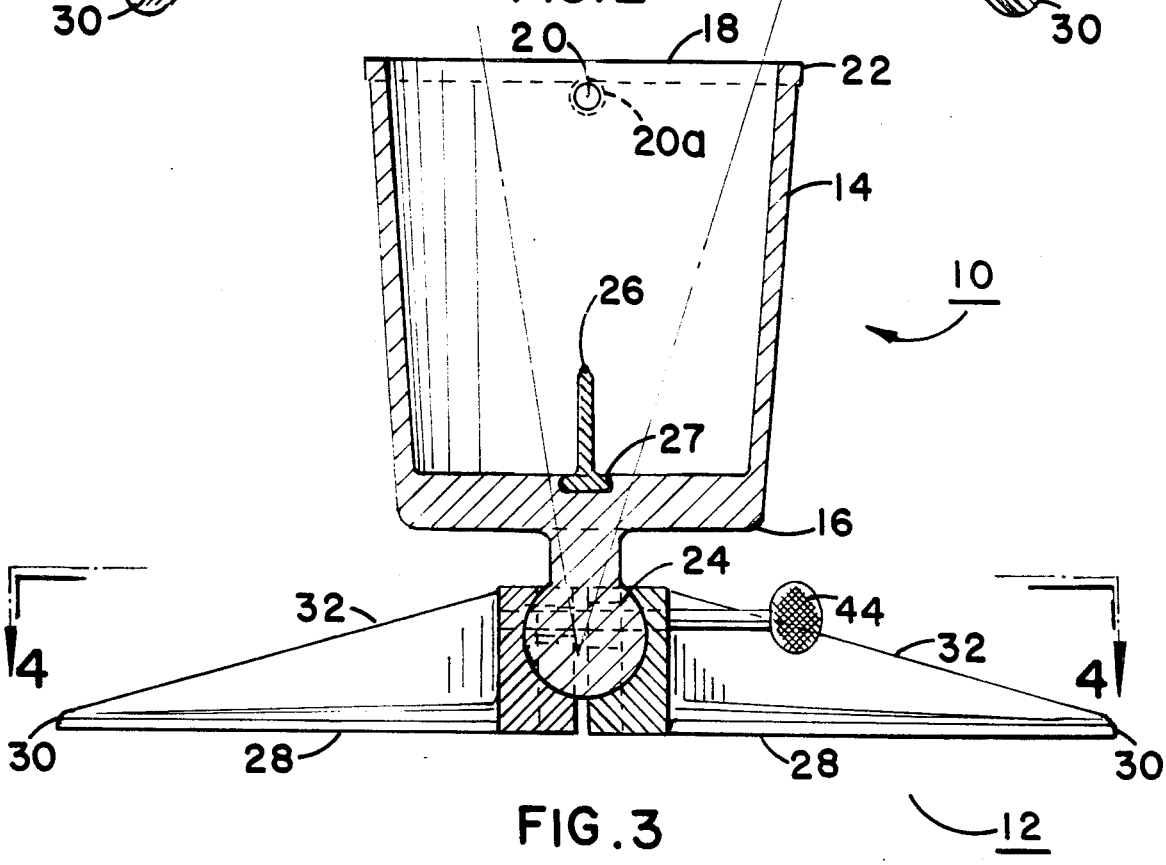
FIG. 3 is a sectional view along line 3—3 of FIG. 2, of the improved stand.

The improved stand 10 illustrated in FIGS. 1 through 6 having a support portion 12 and a receptacle 14. The receptacle 14 is of a sufficient depth and strength to receive and secure a tree, christmas tree, standard and the like. The receptacle 14 is also watertight in order to retain water. The receptacle 14, as illustrated in the drawings tapers outwardly from the bottom end 16 thereof to the portion 18 of the receptacle 14. At some distance from the top end 18 are positioned a plurality of threaded bolts 20. The bolts 20 rotatably engage apertures 20*a* which are threaded. In the embodiment described, there are shown three bolts 20, spaced 120° apart from each other, although the invention is not restricted thereto. Through out this entire specification, like members are given like reference numbers.

For additional structural strength, there is provided at the top end 18, a 360° circumferential shoulder 22. Integral to the receptacle 14, a ball 24. Located within the receptacle 14 at the bottom end 16, there is provided a tapered projection 26 which may take the shape of a nail and which is placed in an aperture 27 provided at the bottom of the receptacle 14.

It has been found that the fabrication of the receptacle 14 lends itself very well to molding methods and a material found to be very easy to work with is aluminum which although very light in weight provides sufficient structural strength for the intended purpose of holding a christmas tree stand or the like in a perpendicular position. The receptacle 14 also lends itself to construction of plastic materials which are well known, and which provide sufficient structural strength and which are also erosion proof.

Again referring to FIG. 1 and the associated drawings, there is disclosed a support portion 12 comprised of two identical members 112 and 212 each member having a pair of support legs. In the illustrated embodiment, there are illustrated, four identical leg supports 28. The leg supports are T-like in construction and is such that at one end 30 thereof, the bottom portion of the T32 is flush with the surface of the top portion 28 of the T, and the bottom portion 32 increases at an angular rate determined by the length of the leg support 28 which terminates at the outside wall of a hub 36. The hub 36 when assembled is formed of two semi-circular structures 36*a* and 36*b*. The interior walls of the hub structures 36*a* and 36*b* form a socket type structure of a size sufficient to receive ball member 24.

Figure 4:
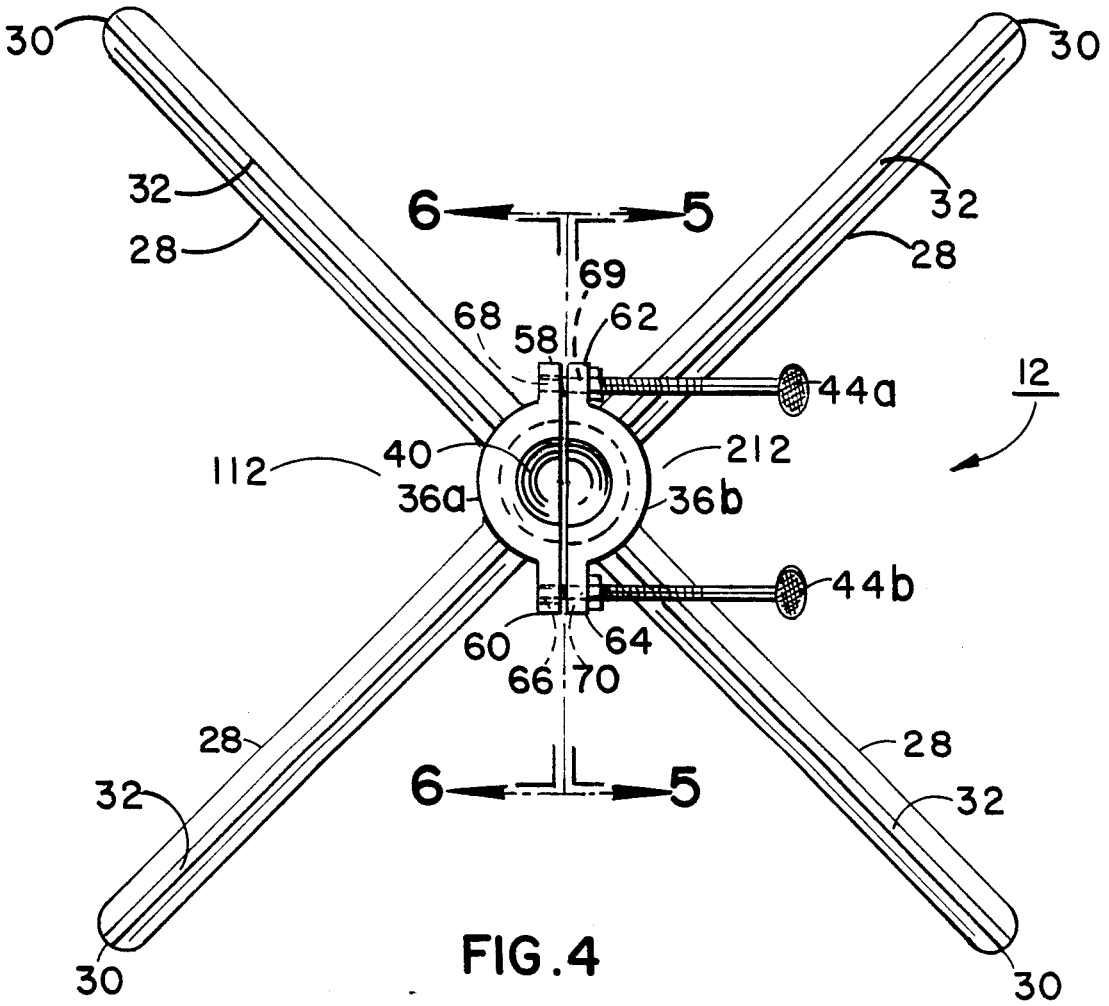
FIG. 4 is a top plan view of the support portion of the improved stand.
Figure 5:
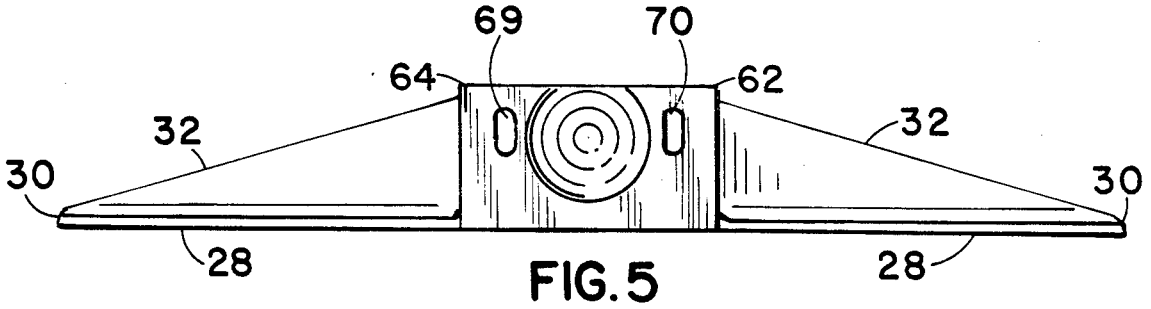
FIG. 5 is a side plan view of the support portion of the improved stand taken along lines 5—5 of FIG. 4.
Figure 6:
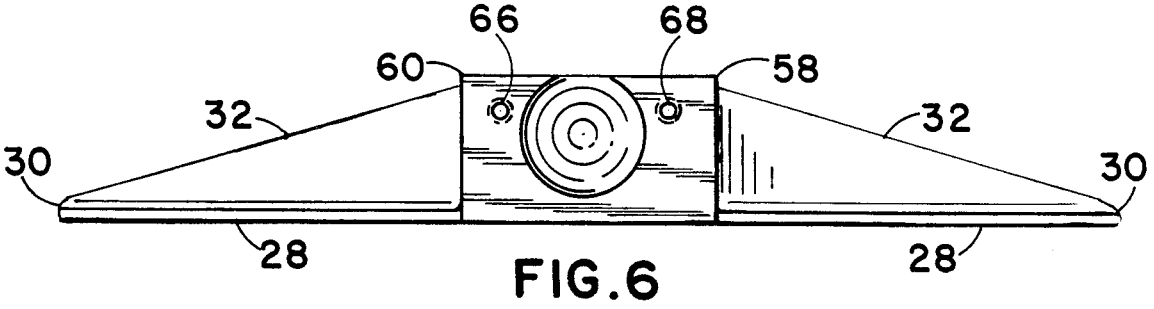
FIG. 6 is a side plan view of the support portion of the improved stand taken along lines 6—6 of FIG. 4.

There is provided on the hub members 36*a* and 36*b* shoulders 58, 60, 62 and 64 which are parallel to the longitudinal axis of the opening 40 shown in FIG. 4. Referring to FIGS. 5 and 6 there are illustrated two members of the support portion 12. The support member shown in FIG. 5 illustrates a member 212 having two elongated holes 69 and 70 the purposes of which will be become clear. The support member illustrated in FIG. 6 shows a member 112 having two threaded apertures therethrough.

The threaded apertures 66 and 68 for receiving bolt 44*a* and 44*b* are located on the shoulders 58 and 60.

Referring again to FIG. 4, non-threaded apertures 69 and 70 for receiving bolts 44*a* and 44*b* are located on shoulders 62 and 64 respectively. The non-threaded apertures 69 and 70 located on shoulders 62 and 64 through which bolts 44*a* and 44*b* are inserted are elongated. The improved stand in its assembled form is illustrated in FIG. 1. The support portions 12*a* and 12*b* are made into one supporting unit by the bolts 44*a* and 44*b*. The ball 24 is placed in the socket formed by the interior walls of the hub 36*a* and 36*b*. The bolts 44*a* and 44*b* are then inserted and hand tightened.

In operation, for purposes of this explanation, a christmas tree is placed in the receptacle 14. The bottom of the tree would be punctured and held by the tapered projection 26, which in the illustrated embodiment is threadably placed in the bottom of the receptacle 14 in a recess 27. This type of connection makes the replacement of the projection 26 quite easy in the event the projection 26 is broken or loses its utility to puncture the tree. The bolts 20 are then tightened in a manner such that the tree is relatively perpendicular to the ground. In order to finally placed the tree in a position such that it is truly perpendicular, it is simply necessary place the tree in its final position simply by grabbing the trunk and moving it and then tightening the bolts 44*a* and 44*b*. In the event that the floor is uneven, the purpose of the elongated apertures 69 and 70 can now be appreciated. The leg portions of 12 can be swung in an up and down direction in order to accomodate uneven floors.

The method of manufacturer for the support portions 12 is the same on that for the receptacle 14, i.e., molding methods using materials such as aluminum, plastic or the like, the only requirement being that the material be structurally strong and erosion proof.

In the event that one desires to support an unusually large trees, FIGS. 1*a*, 1*b* and 1*c* illustrate a leg support extender 128 which are simply placed over the support legs 28 which effectively increases the length of the legs 28 thereby imparting increased support to the stand 10.

Referring to FIG. 2, it can be seen that the support stand 10 can be adjusted into an infinite number of positions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. For example, the support legs 28 in this specification are described as being T-shape in configuration. The legs 28 do not have to be restricted to such a configuration, they can be triangular, hollow, flat or any other type of configuration, the only restriction being that the legs 28 have sufficient structural strength to support the stand and tree.

What is claimed:

1. An improved support stand comprising:

a first support member including a pair of support legs terminating in a concave wall member, wherein interior walls of said wall member defines a hemispheric cavity, said wall member also including a pair of shoulder members each having a threaded aperture therethrough, a second support member including a pair of support legs terminating in a concave wall member, wherein interior walls of said wall member defines a hemispheric cavity, said wall members also including a pair of shoulder members having one aperture and one elongated aperture therethrough, said threaded aperture and said elongated aperture being in radial alignment with said threaded aperture of said first support member, said first and second support members maintained in a fixed relationship to each other by fastening means engaged by said threaded apertures, receptacle means closed at one end and open at the other end and provided with a circumferential shoulder at said open end, said shoulder provided with a plurality of threaded apertures, and further provided with a plurality of threaded bolt means for each threaded aperture, said bolt means engaging an elongated foreign member placed in said receptacle means, and said elongated aperture on said second support member permitting the adjustment of said support legs for various positions of inclination thereby allowing the use of said support stand on uneven surfaces.

2. An improved stand as set forth in claim 1 wherein said second support member includes two elongated apertures.

3. An improved support stand as set forth in claim 2 wherein said support legs are provided with leg extenders.

* * * * *